US005967207A

United States Patent [19]

Chen

[11] Patent Number: 5,967,207

[45] Date of Patent: Oct. 19, 1999

[54] METHOD OF FABRICATING BAMBOO SLATS FOR VENETIAN BLINDS

[76] Inventor: Feng-Yuan Chen, 3F, No. 28, Lane, 59 Rose Rd., Hsin-Tien City, Taipei Hsien, Taiwan

[21] Appl. No.: 09/190,106

[22] Filed: Nov. 12, 1998

[51] Int. Cl.[6] ..... B27F 7/00; B27H 1/00

[52] U.S. Cl. ..... 144/345; 144/3.1; 144/5; 144/355; 144/354; 144/360; 144/361; 144/364; 144/367; 144/380; 144/369; 428/105; 428/106; 428/378

[58] Field of Search ..... 144/2.1, 3.1, 5, 144/344, 345, 346, 348, 351, 352, 353, 355, 359, 360, 364, 367, 369, 380; 428/104, 105, 106, 107, 378, 114, 393, 407, 172, 113

[56] References Cited

U.S. PATENT DOCUMENTS

| | | | |
|---|---|---|---|
| 5,441,787 | 8/1995 | Fujii et al. | 144/358 |
| 5,505,238 | 4/1996 | Fujii et al. | 144/346 |
| 5,896,903 | 4/1999 | Chen et al. | 144/3.1 |

*Primary Examiner*—W. Donald Bray
*Attorney, Agent, or Firm*—Rosenberg, Klein & Bilker

[57] ABSTRACT

A method of fabricating bamboo slats into bamboo blinds, wherein bamboo wood is cut into bamboo strips of predetermined length. The bamboo strips are polished, then boiled in a hydrogen peroxide solution for bleaching the strips. The bamboo strips are then spliced into raw bamboo slats of a predetermined thickness. Next, the bamboo slats are subjected to grinding. Subsequently the bamboo slats are primed, and then molded by heat pressing. Holes are then punched in the bamboo slats for insertion of a pull cord, so that the finished bamboo slats can be assembled into a Venetian blind.

8 Claims, 7 Drawing Sheets

METHOD OF FABRICATING BAMBOO SLATS FOR VENETIAN BLINDS

FIELD OF THE INVENTION

The present invention relates to a method of fabricating bamboo slats for Venetian blinds. More particularly, this method is provided which uses bamboo wood as material for making slats.

BACKGROUND OF THE INVENTION

Conventionally, the slats for Venetian blinds are made from wooden material for the advantages for fine touch and goof outer appearance. However, because forests are over-cultivated in recent years, it is difficult to obtain sufficient supply of wooden material, and the cost of wooden material has become very high. Furthermore, because the fiber structure of wooden material can not bear high compression strength. Polyvinyl chloride and aluminum are also conventionally used for making slats for Venetian blinds. However, the fabrication of plastic slats will cause pollution. The way may hurt the fingers.

This application is related to U.S application Ser. No. 09/055,748, filed on Apr. 7, 1998, entitled "METHOD OF FABRICATING bamboo SLATS FOR BAMBOO BLINDS", INCORPORATED HEREIN BY reference.

SUMMARY OF THE INVENTION

It is an object of the present invention to provide a slat fabrication method which uses bamboo wood as material for making slats.

A more specific object of the present invention is to provide a method for making useful bamboo wood from tree having a small diameter.

In accordance with one aspect of the present invention, the bamboo slat fabrication method comprises the steps of: i) selecting bamboo wood 1 from bamboo cane, and cutting the selected bamboo wood into bamboo strips; ii) polishing the bamboo strips, and boiling the bamboo strips in a hydrogen peroxide solution for bleaching; iii) splicing the bamboo strips into bamboo slats of a desired thickness, and grinding the bamboo slats by blasting; iv) coating the bamboo slats with a priming, and molding the bamboo slats by heat pressing; and v) punching holes on the bamboo slats for inserting pull cord, and assembling the pull cord into a Venetian blind to be a set of bamboo slats.

In accordance with another aspect of the present invention, the bamboo slat fabrication method further comprises the steps of: i) selecting bamboo wood from a bamboo cane; ii) removing the skin of the bamboo wood; iii) cutting the bamboo wood into strips by a rotary cutter, and boiling the bamboo strips in a hydrogen peroxide solution for bleaching, and drying the bamboo strips in a heating shamber at 50° C.~60° C. with 48 hours for internal stress relief; iv) slicing the bamboo strips into bamboo slats of desired thickness, and grinding the bamboo slats; v) coating the bamboo slats with a priming, and molding the bamboo slats by heat pressing; and vi) coating the bamboo slats with a face coating, and punching holes on the bamboo slats for inserting pull cord, and assembling the pull cord into a Venetian blind to be a set of bamboo slats.

These as well as other objects and advantages of the present invention will become apparent from the following detail description and accompanying drawings.

These as well as other objects and advantages of the present invention will become apparent from the following detail description and accompanying drawings.

DETAILED DESCRIPTION OF THE PREFERRED EMBODIMENT

Figure 1:
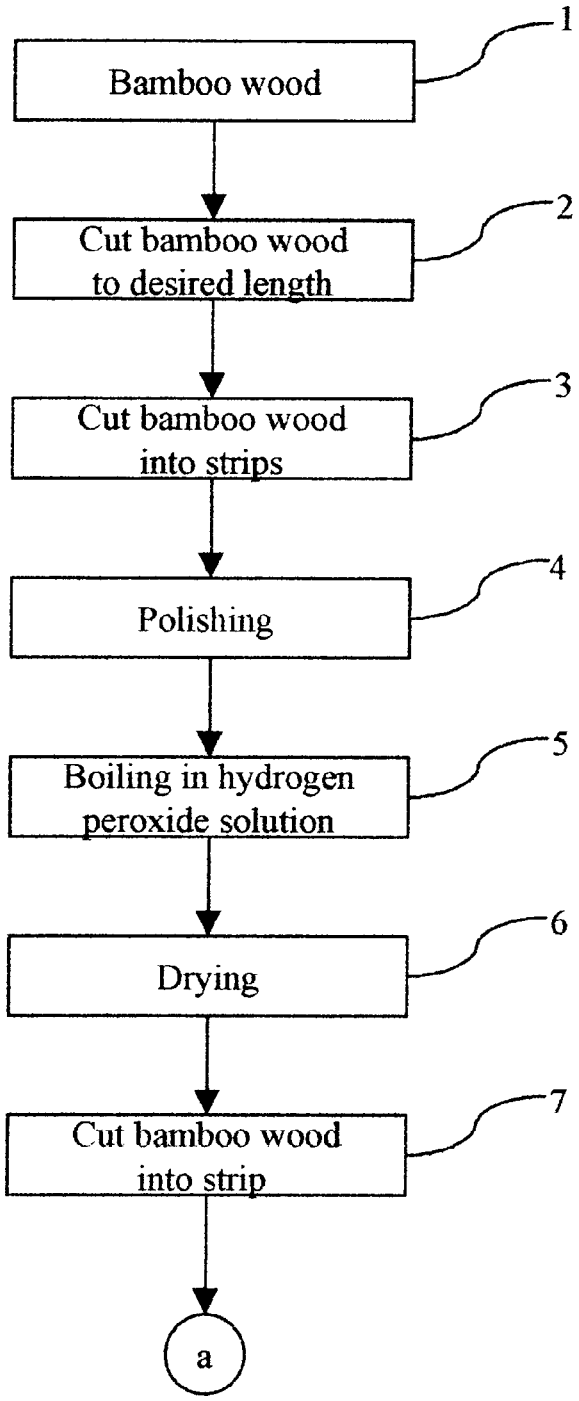
FIG. 1 and FIG. 2 are a bamboo slat fabrication block diagram according to the present invention.
Figure 2:
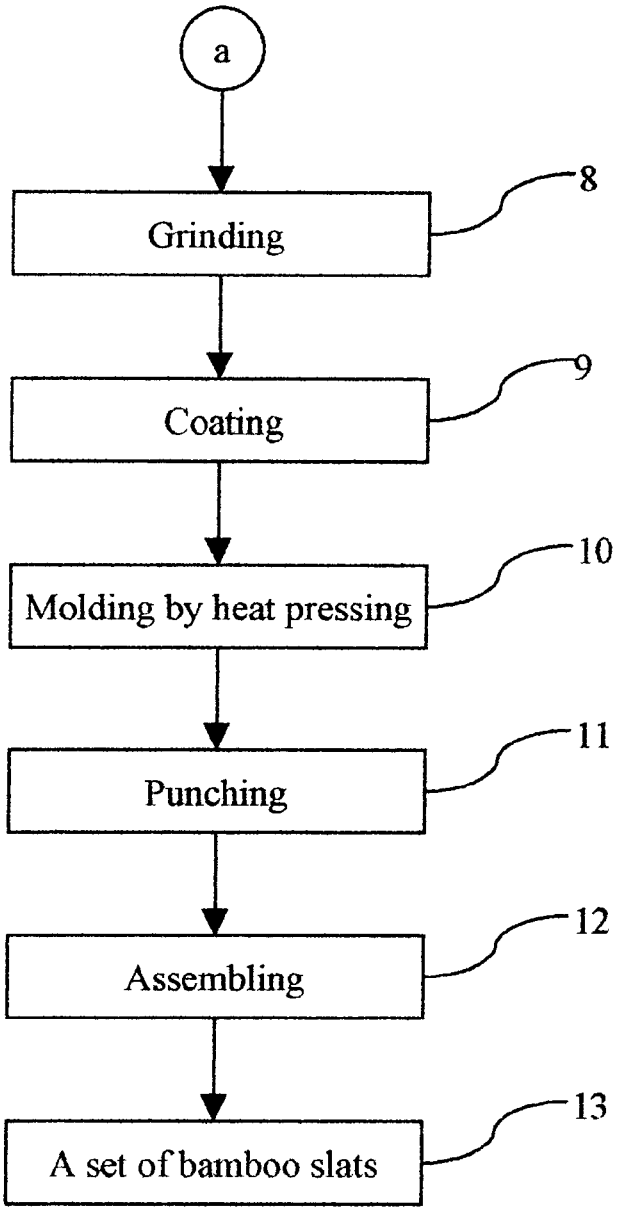
Figure 3:
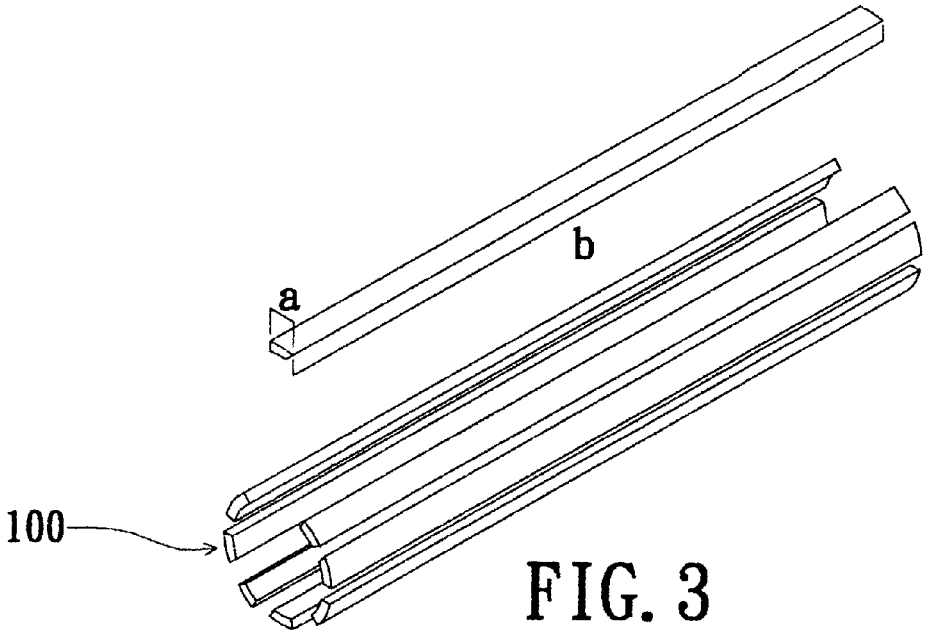
FIG. 3 shows a bamboo wood cut into bamboo strips according to the present invention.
Figure 4:
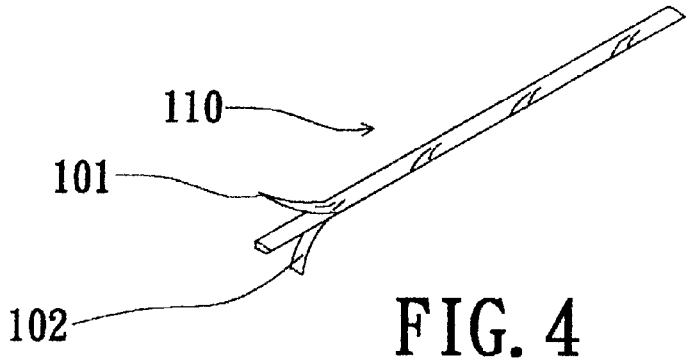
FIG. 4 shows the skin and joint removed from both sides of the bamboo strip according to the present invention.
Figure 5:
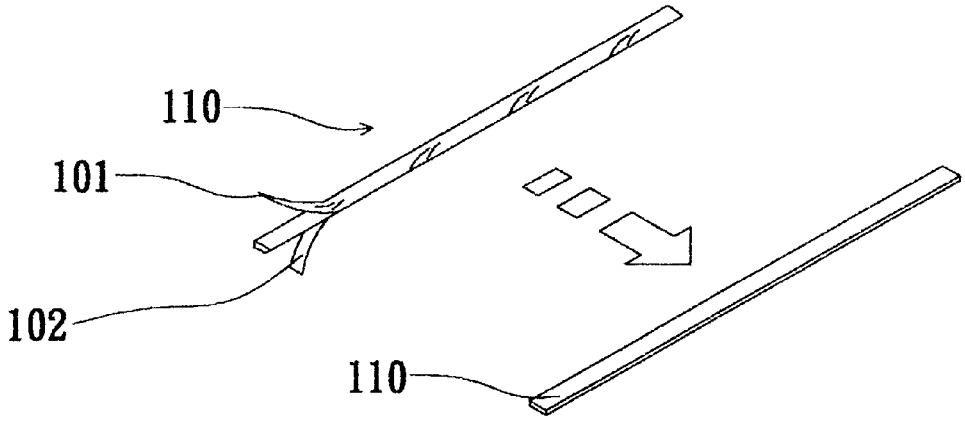
FIG. 5 shows the bamboo strip of FIG. 4 processed into a fine bamboo strip.
Figure 6:
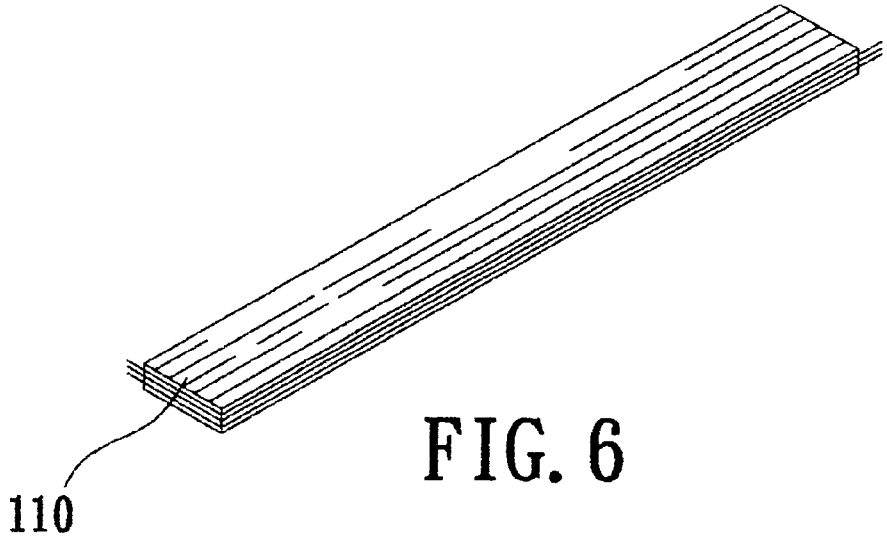
FIG. 6 shows the bamboo plate trimmed according to the present invention.
Figure 7:
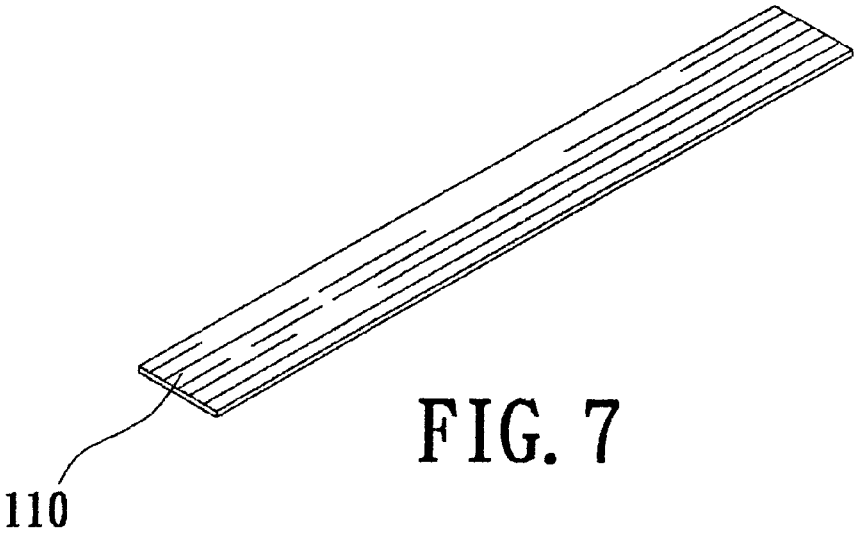
FIG. 7 shows a raw bamboo slat split from a bamboo plate according to the present invention.
Figure 8:
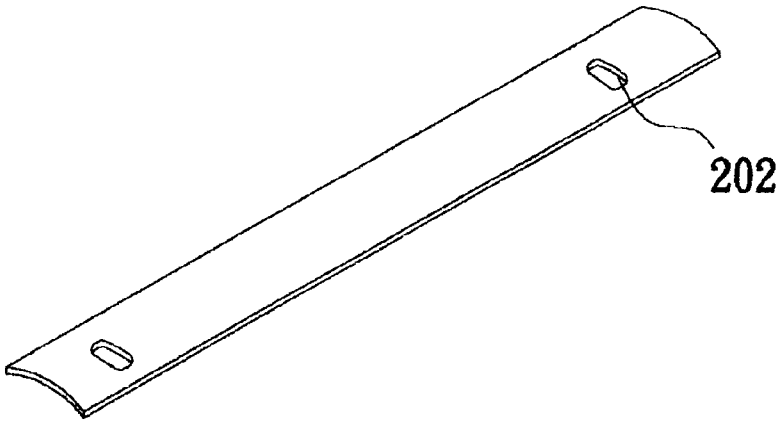
FIG. 8 shows a finished bamboo slat according to the present invention.
Figure 9:
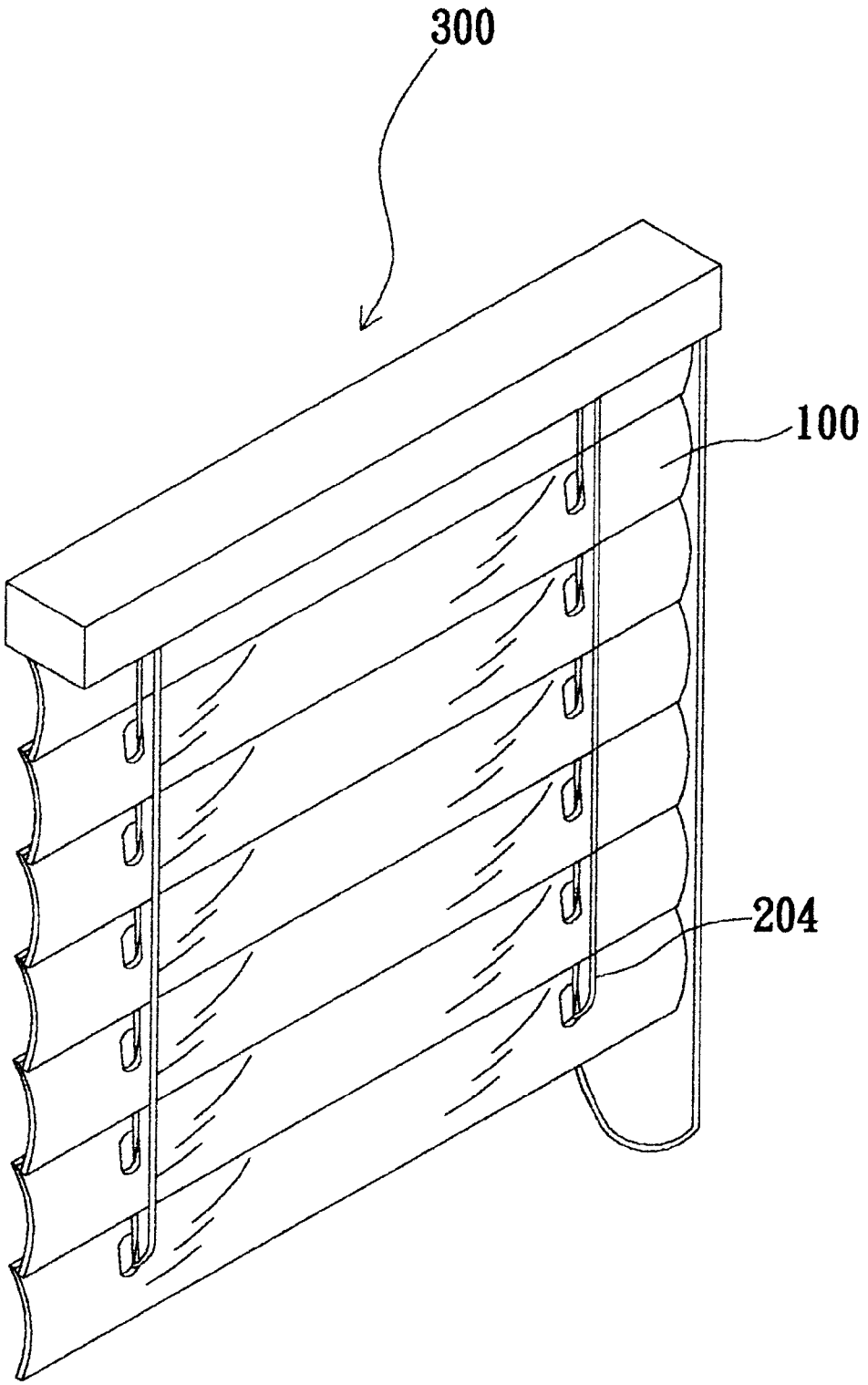
FIG. 9 shows a bamboo blind constructed according to the present invention.

Referring to FIGS. 1 and 2, a bamboo slat fabrication method in accordance with the present invention comprises the steps of:

i) selecting bamboo wood 1 from bamboo cane which has a diameter at least 90 cm and a thickness at least 10 mm, and cutting from a bamboo tree ranged from 3 to 4 years old having an elevation diameter 10 cm above root of the bamboo tree, and cutting 3 the selected bamboo wood into bamboo strips 100 subject to a desired length and a desired width 2(shown in FIGS. 3 and 4);

ii) polishing 4 the bamboo strips 100 of width a with 28 mm, and boiling 5 the bamboo strips 100 in a hydrogen peroxide solution for bleaching, and drying 6 the bamboo strips 100 in heating shamber at 50° C.~60° C. with 48 hours for internal stress relief(shown in FIG. 5);

iii) splicing 8 the bamboo strips 100 into bamboo slats 110 of a desired thickness, and grinding 9 the bamboo slats 110 by blasting(shown in FIG. 6);

iv) coating 10 the bamboo slats 110 with a priming, and molding 11 the bamboo slats 110 by heat pressing(shown in FIG. 7); and v) punching 13 holes 202 on the bamboo slats 110 for inserting pull cord 204, and assembling 14 the pull cord 204 into a Venetian blind 300 to be a set of bamboo slats 110(shown in FIGS. 8, and 9).

Figure 10:
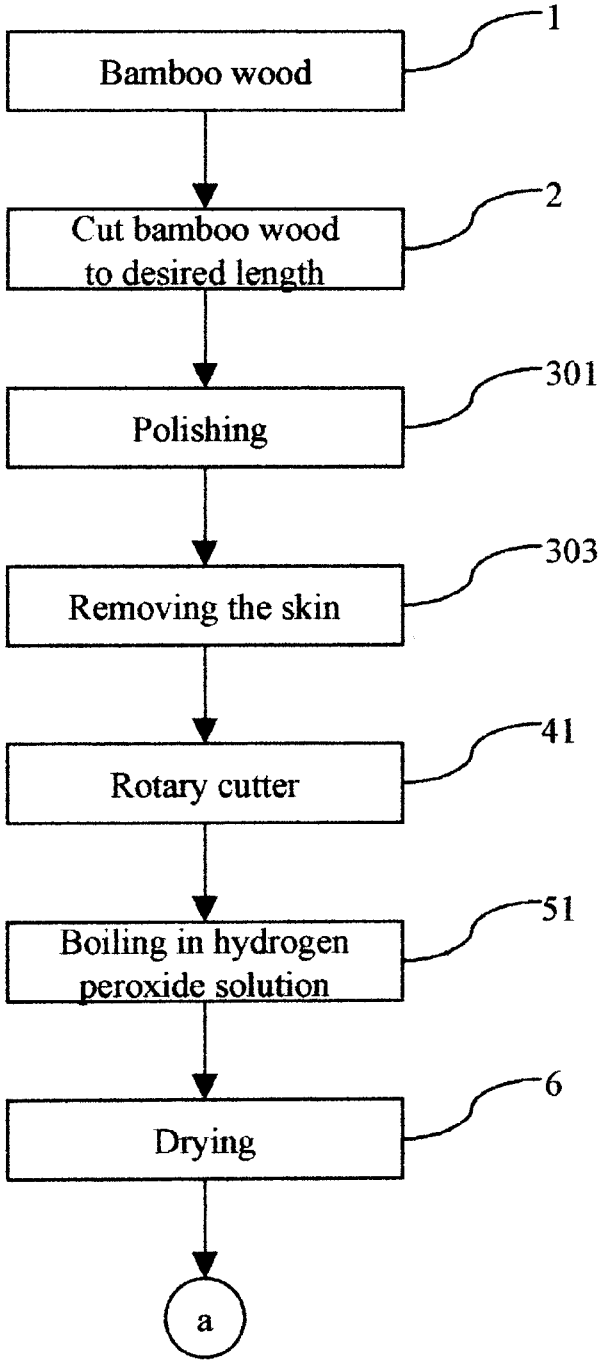
FIG. 10 and FIG. 11 shows a bamboo slat fabrication block diagram according to another embodiment of the present invention.
Figure 11:
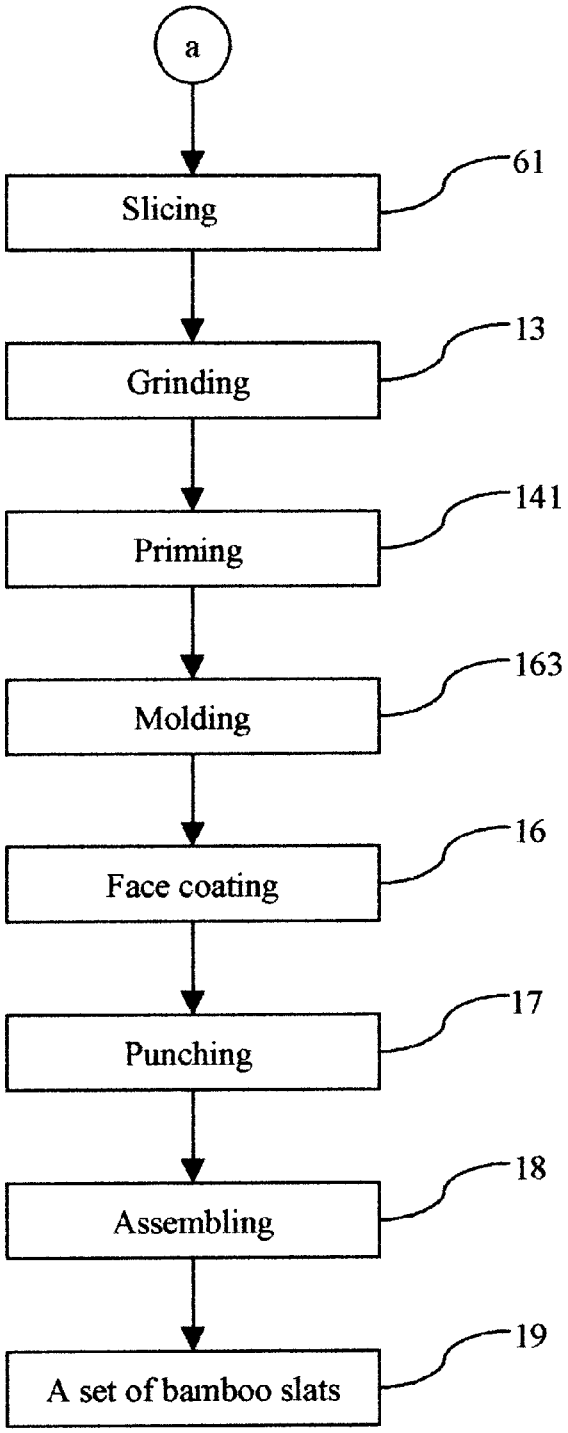

Referring to FIGS. 10 and 11, shown a bamboo slat fabrication block diagram according to another embodiment of the present invention which comprises the steps of:

i) selecting bamboo wood 1 from a bamboo cane subject to a desired length and a desired width 2;

ii) removing the skin 301 of the bamboo wood;

iii) cutting 41 the bamboo wood into strips 100 by a rotary cutter, and boiling 51 the bamboo strips 100 in a hydrogen peroxide solution for bleaching, and drying 6 the bamboo strips 100 in a heating shamber at 50° C.~60° C. with 48 hours for internal stress relief;

iv) slicing 61 the bamboo strips 100 into bamboo slats 200 of desired thickness, and grinding 41 the bamboo slats 200;

v)coating the bamboo slats 200 with a priming 141, and molding 163 the bamboo slats 200 by heat pressing; and vi) coating the bamboo slats 200 with a face coating 16, and punching 17 holes 202 on the bamboo slats 200 for inserting pull cord 204, and assembling 18 the pull cord 204 into a Venetian blind 300 to be a set of bamboo slats.

As various changes can be made in the above-described construction without departing from the scope of the invention, it is intended that all matter contained in the above description and drawings be interpreted as illustrative and not in a limiting sense.

What the invention claimed is:

1. A method of fabricating bamboo slats for Venetian blinds, comprising the steps of:

i) selecting bamboo wood from a bamboo cane, and cutting said selected bamboo wood into bamboo strips subject to a desired length and a desired width;

ii) polishing said bamboo strips, and boiling said bamboo strips in a hydrogen peroxide solution for bleaching, and drying said bamboo strips in a heating shamber at 50° C.~60° C. with 48 hours for internal stress relief;

iii) splicing said bamboo strips into bamboo slats of a desired thickness, and grinding said bamboo slats by blasting;

iv) coating said bamboo slats with a priming, and molding said bamboo slats by heat pressing; and v) punching holes on said bamboo slats for inserting pull cord, and assembling said pull cord into a Venetian blind to be a set of bamboo salts.

2. The method of claim 1, wherein the hardness of the bamboo slats thus obtained from step v) is ranged from 1H to 4H.

3. The method of claim 1, wherein said bamboo wood is selected from said bamboo cane which has a diameter at least 9" and a thickness at least 10 m/m, and is cut from a bamboo tree ranged 3 to 4 years old.

4. The method of claim 1, wherein said base coating used in step iv) is obtained from a digestive fiber, surfacer and resin mixture.

5. The method of claim 1, wherein said bamboo slats used in step iv) is used by two plates at a heating temperature 100° C. for press molding.

6. A method of fabricating bamboo slats for Venetian blinds, comprising the steps of:

i) selecting bamboo wood from a bamboo cane subject to a desired length and a desired width;

ii) removing a skin of said bamboo;

iii) cutting said bamboo into strips by a rotary cutter, and boiling said bamboo strips in a hydrogen peroxide solution for bleaching, and drying said bamboo strips in a heating shamber at 50° C.~60° C. with 48 hours for internal stress relief;

iv) slicing said bamboo strips into bamboo slats of desired thickness, and grinding said bamboo slats;

v) coating said bamboo slats with a priming, and molding said bamboo slats by heat pressing; and vi) coating said bamboo slats with a face coating, and punching holes on said bamboo slats for inserting pull cord, and assembling said pull cord into a Venetian blind to be a set of bamboo slats.

7. The method of claim 2, wherein said priming used in step iv) is obtained from a digestive fiber, resin, surfacer and organic solvent mixture.

8. The method of claim 2, wherein said primed bamboo slats obtained from step v) have hardness ranged from 1H to 4H.

* * * * *